US008907221B1

(12) United States Patent
Mohanty et al.

(10) Patent No.: US 8,907,221 B1
(45) Date of Patent: Dec. 9, 2014

(54) REINFORCED INTELLIGENT CABLES

(75) Inventors: Soumendra Mohanty, San Jose, CA (US); Ning Zhu, San Jose, CA (US)

(73) Assignee: Analogix Semiconductor, Inc., Santa Clara, CA (US)

( * ) Notice: Subject to any disclaimer, the term of this patent is extended or adjusted under 35 U.S.C. 154(b) by 216 days.

(21) Appl. No.: 13/401,689

(22) Filed: Feb. 21, 2012

Related U.S. Application Data

(60) Provisional application No. 61/445,498, filed on Feb. 22, 2011.

(51) Int. Cl.
*H01B 7/08* (2006.01)

(52) U.S. Cl.
USPC ..... 174/117 F; 174/117 FF

(58) Field of Classification Search
CPC .. H01R 13/66; H01R 13/665; H01R 13/6658; H01R 13/6466; H01R 13/6469
USPC ..... 174/268, 117 F, 117 FF
See application file for complete search history.

(56) References Cited

U.S. PATENT DOCUMENTS 6,797,891 B1 * 9/2004 Blair et al. ..... 174/268
7,865,629 B1 * 1/2011 Tantos et al. ..... 710/11

OTHER PUBLICATIONS

SMSC, UFX6000 USB 2.0 Hi-Speed Graphics Controller with VGA, HDMI/DVI, and Digital RGB Interfaces, Dec. 16, 2010 pp. 1-5.*

* cited by examiner

*Primary Examiner* — Jeremy C Norris
(74) *Attorney, Agent, or Firm* — Carr & Ferrell LLP

(57) ABSTRACT

Provided are cables for transmitting media data between media transmitters and receivers. A cable includes an integrated circuit for performing this data transmission and, in certain embodiments, various other functions. The integrated circuit may be enclosed in a base member used to support one of the connectors of the cable. The cable also includes a flexible member extending between this base member and another connector. A portion of the cable protrudes into the base member and makes electrical connections to conductive points of the integrated circuit or, more specifically, to conductive points on a connection pad of the circuit. The cable is rigidly supported and mechanically secured to the base member to preserve these electrical connections, particularly when mechanical stress is applied to the flexible member. In certain embodiments, the base member includes one or more notch members and/or enclosure members to ensure this support.

16 Claims, 5 Drawing Sheets

REINFORCED INTELLIGENT CABLES

CROSS-REFERENCE TO RELATED APPLICATIONS

This application claims the benefit of U.S. Provisional Application No. 61/445,498, filed Feb. 22, 2011, which is incorporated herein by reference in its entirety.

BACKGROUND

Mobile phones, tablet computers, laptops, ultra-books, and other types of mobile electronic devices are becoming increasingly popular as media generating, media retrieving, and media transmitting devices. However, these devices are often not optimal for viewing content because of their small displays and low powered audio outputs. To transmit media data, such as movie clips, pictures, and other types of data, these electronic devices are often connected to other devices such as computer displays, televisions (TV), projectors, and the like. Various interconnecting devices, such as cables and/or various combinations of dongles and cables, may be used for this purpose.

An interconnecting device typically includes two connectors and electrical conductors coupling the terminals of these two connectors. Connectors may be coupled to receptacles of the electronic device, such as its video and/or audio ports, data ports, and the like, or may be coupled to connectors of other interconnecting devices. Multiple cables and dongles are often used in series to interconnect two connectors of electronic devices in order to ensure support of various connection and data transmission standards and/or provide additional functionality.

Various data transmission standards have been recently developed. Some examples include universal serial bus (USB), FireWire, high-definition multimedia interface (HDMI), and others. In order to accommodate each of these standards, dedicated data ports are typically employed in the electronic device. For example, an electronic device that has USB capability typically includes a dedicated port for a USB connector.

SUMMARY

Provided are cables for transmitting media data between media transmitters and receivers. A cable includes an integrated circuit for performing data transmission and, in certain embodiments, various other functions. The integrated circuit may be enclosed in a base member used to support one of the connectors of the cable. The cable also includes a flexible member extending between the base member and another connector. A portion of the cable may protrude into the base member and make electrical connections to conductive points of the integrated circuit or, more specifically, to conductive points on a connection pad of the circuit. The cable may be rigidly supported and mechanically secured to the base member to preserve these electrical connections, particularly when mechanical stress is applied to the flexible member. In certain embodiments, the base member includes one or more notch members and/or enclosure members to ensure this support.

In certain embodiments, a cable for transmitting media data includes a first connector, second connector, base member, integrated circuit, and flexible member. The first connector may include a first plurality of conductive points for establishing a connection with a media transmitter. The second connector may include a second plurality of conductive points for establishing a connection with a media receiver. The base member mechanically supports the second connector and encloses the integrated circuit, which is connected to the second plurality of conductive points in some embodiments. The integrated circuit may also include a connection pad having a third plurality of conductive points. The flexible member of the cable may extend between the first connector and base member. The flexible member may include a plurality of wires interconnecting the first plurality of conductive points of the first connector and the third plurality of conductive points of the connection pad. A portion of the flexible member may protrude into the base member and be rigidly supported by the base member, thereby reducing the stress on the connections between the plurality of wires of the flexible member and the third plurality of conductive points of the connection pad.

In certain embodiments, the base member includes one or more notch members securing and rigidly supporting the flexible member as it protrudes into the base member. The one or more notch members may form a cavity within the base member such that wires of the plurality of wires individually extend to the third plurality of conductive points within this cavity. In certain embodiments, the flexible member includes an insulating sheath insulating and mechanically integrating the plurality of wires. The plurality of wires may be substantially free from the insulating sheath while extending through the cavity.

In certain embodiments, the base member includes an enclosure member provided in the cavity formed by the one or more notch members. The enclosure member may support individual wires of the plurality of wires. The enclosure member may prevent the plurality of wires from being pulled out of the cavity. In certain embodiments, the cavity may be filled with a filling material. In certain embodiments, one or more notch members are molded over a portion of the flexible member. In the same or other embodiments, one or more notch members are compressed around a portion of the flexible member.

Examples of media transmitters for connecting to the first connector include a mobile phone, laptop computer, and tablet computer. In certain embodiments, the first connector includes a micro-USB connector. Examples of media receivers for connecting to the second connector include a TV set, video display, and video projector. In certain embodiments, the second connector includes an HDMI connector. The base member enclosing the integrated circuit and supporting the second connector may a part of the docking station. In certain embodiments, the first connector and/or second connector is a male connector. The integrated circuit may be configured to recycle power back to the first connector and/or to generate a signal delivered to the second connector.

These and other embodiments are described further below with reference to the figures.

DETAILED DESCRIPTION

Figure 1A:
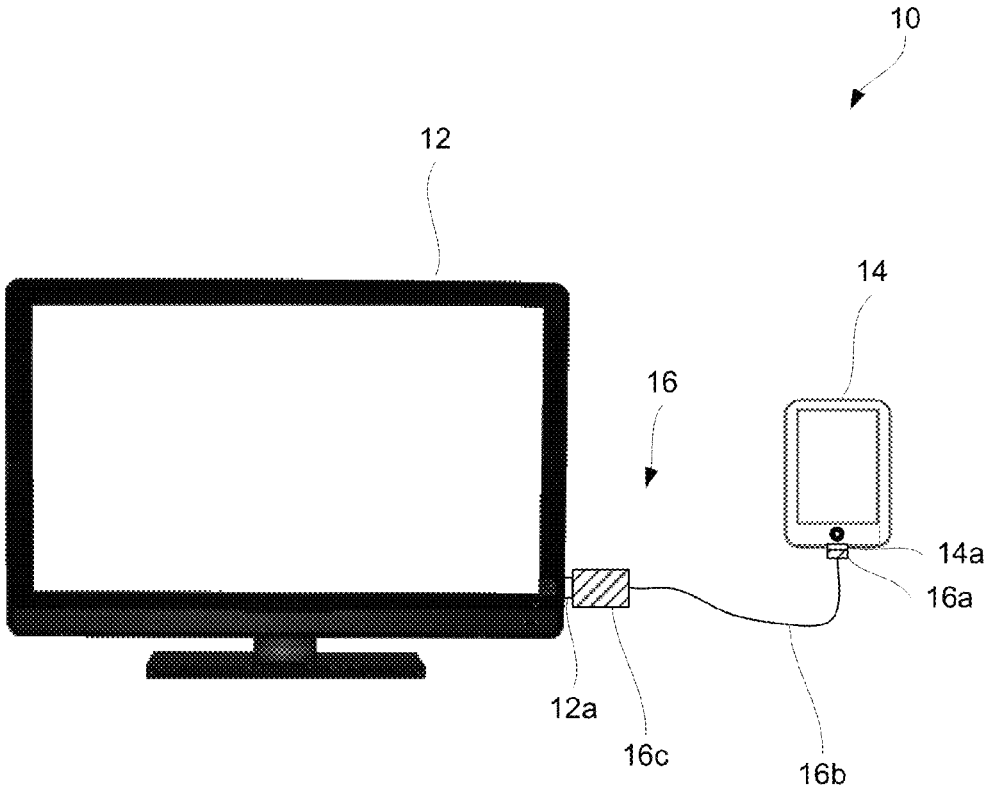
FIG. 1A is a schematic representation of a system including a media transmitter and media receiver interconnected by a cable, in accordance with certain embodiments.

Various cables, dongles, and other types of devices may be used for transmission of data between two devices and for performing other functions. These data transmission devices may be divided into two general categories: active devices and passive devices. Active devices use embedded integrated circuits (e.g., a silicon chip) to boost their performance. Passive devices do not include integrated circuits and are liable to degrade the data they carry, due to such "channel impairments" as attenuation, crosstalk, and group velocity distortion. The integrated circuits of the active devices may be used to compensate for some or all of these impairments and/or to provide other functions further described below. This active boosting allows active devices to be more compact, thinner, longer, and transmit data faster than their passive equivalents.

Embedding integrated circuitry into data transmission devices allows for reducing cross-section of data transmitting wires, reducing the overall form factor and weight of the device, and providing other functions and benefits. For example, active devices allow for longer reach and lower power consumption. Examples of active data transmission devices include ANX7805, ANX7730, and ANX9832 supplied by Analogix Semiconductors in Santa Clara, Calif.

Data transmission devices may be also categorized into cables and dongles. A cable is used for direct connection to both transmitter and receiver. A dongle is generally a shorter version of the cable and is used to connect to one or more other cables. Therefore, a dongle may be only directly connected to either a transmitter or receiver, but not to both. A dongle generally has a male connector on one end and a female connector on the other end. A cable typically has male connectors on both ends. Other combinations of connectors for dongles and cables may also be provided in some embodiments.

Both cables and dongles may be comprised of two or more wires running side by side and bonded, twisted or braided together to form a single assembly, which is often referred to as a flexible member of a dongle or cable. Connectors (male or female) may be provided on both ends of this flexible member. When a data transmitting device is active and includes an integrated circuit, this circuit may be integrated into one of the connectors or, more specifically, into a base member that encloses the circuit and supports one of the connectors.

In certain embodiments further described below, an active cable includes a male micro or mini-USB connector on one end and a standard male display interface connector at the other end, such as an HDMI connector, Video Graphics Array (VGA) connector, DisplayPort connector, and the like. The micro or mini-USB connector may be used for connecting to a mobile device, while the HDMI connector may be plugged into a TV set. In response to the mobile device initiating a media display on its interface, the corresponding data may be transmitted to and displayed on the TV set. The integrated circuit may be embedded into a base member supporting the HDMI connector. The base member may be encased by plastic around the connector, such that it is not obvious to a user that there is an integrated circuit inside. Cable lengths may vary as desired. For example, cable lengths may vary to a total length of up to about five meters in some embodiments.

Fabrication and operations of active data transmission devices present a set of challenges often associated with mechanical uses of the cables. Such devices are often connected and disconnected from transmitters and receivers by exerting substantial forces on the connectors. Integrating Integrated Circuits (ICs) and providing additional connections makes active data transmission devices more susceptible to mechanical failure. Often active data transmission devices are made into dongles that are then connected to passive cables to avoid stresses, at least on portions of these assemblies that include ICs.

The described technology may include an intelligent cable mechanism, which is often referred to as a cable, for interconnecting a media transmitter and media receiver. In a specific embodiment, a cable may be used for connecting a mobile device, such as a smart phone, with a high definition television (HDTV) or some other media receiver. Once connected, the cable may perform one or more of several functions that are further explained below. For example, the cable may detect connection types between the devices that are connected to the cables. The cable may switch communication lines extending to pluralities of conductive points of the connector (for example, based on a detected connection or change in connection). The cable may charge a device connected to the cable, such as media transmitter. Furthermore, the cable may be used for authentication of one or both devices connected to the cable. (further detail of the latter four functions are also described in U.S. patent application Ser. No. 13/371,110, filed Feb. 10, 2012, incorporated by reference herein). Other functions further described below are also with the scope.

Each one of these functions will now be specifically described. A charging feature of the cable may be used to charge one or both of the devices connected to the cable. For example, the intelligent cable mechanism may be used to interconnect a media device and mobile device. In a specific embodiment, a portion of the cable may be implemented as a docking station for the mobile device. Power for charging may be received from an external power source, such as a docking station power source or a power source connected to one of the connector or converter board. For example, a voltage inverter supplying about 5V Direct Current (DC) may be used as an external power source. It should be noted that the term "external" is used merely to distinguish the source of the power. The external power is thereby distinguished from the power provided by the connector of one or both interconnected devices, which may be referred to as an "internal" power. The internal power is generally limited and, in certain embodiments, is substantially lower than the "external" power. Furthermore, some internal power may be consumed during media data transmission and other functions of the cable as further explained below.

In other embodiments, the power to one of the connected devices may be provided by another device. For example, an HDMI port of a TV set may be used as a power source to charge a mobile device connected to the other end of this cable. Such an internal power transfer may be performed while media data is also being transferred between the two. A different kind of power transfer may appear when no data transfer occurs. For example, a mobile device may be charged while an active video stream is communicated over the intelligent cable mechanism or while no active video stream is communicated over the intelligent cable mechanism. Furthermore, the cable itself may generate some data stream to deliver to one of the devices to prevent the device from shutting down or going into a power saving mode.

In the same or other embodiments, the intelligent cable mechanism may include a chip authentication mechanism. The chip authentication may have a logic that authenticates one or more devices connected to the cable. Alternatively or in addition to these embodiments, the cable may be authenticated by one or both connected devices. For example, a cable may include a unique identification verifiable by a mobile device when connected to the cable. If the cable is authenticated, the cable may be used to transmit data to a media device. If the cable is not authenticated, the cable may not be used to transmit data to a media device. In some embodiments, the authentication may be performed between logic located at different locations among a mobile device connected to one end of the intelligent cable mechanism, the media device connected to the other end of the intelligent cable mechanism, and the intelligent cable mechanism.

In certain embodiments, the intelligent cable mechanism includes a wiring mechanism that is configured to detect and differentiate among various types of connections made to the cable. For example, the mechanism may determine that a connection is not a USB type connection, and therefore will not send data via USB 2.0 or 3.0 protocols. Instead, other protocols will be used, such as HD video and audio data.

In certain embodiments, the intelligent cable mechanism includes a switching mechanism, which is able to switch between different connection protocols. The cable may allow a first type of data associated with a first connector to pass through over a first data link. The cable may also detect a connection of its second connector. The cable may switch from the first data link to a second data link. For example, the cable may switch from a USB link to a high definition audio-video link. This feature may be combined with the authentication feature. In the above example, the authentication process may occur, and the second link may be used to transmit data associated with the second connector. In some embodiments, the cable may detect the change in connection type, change a data transmission link within the cable, and indicate to a mobile device connected to the cable that the cable is ready to transfer data. In some embodiments, the cable may detect the change in connection type, instruct an external entity to change the data transmission link (for example, a processing unit within the mobile device), and indicate to the mobile device connected to the cable that the cable is ready to transfer data.

Also provided are various structural features and circuitry and components for performing the functionality described herein, including connectors, data link mechanisms (such as wires that communicate data between two or more connectors), and other components. The cable may include one or more processors, which execute instructions stored in memory, with the executed instructions causing one or more processors to perform the functions discussed herein.

Some of these features will now be explained in more detail with reference to various figures. FIG. 1A is a schematic representation of system 10 including media transmitter 14 and media receiver 12 interconnected by intelligent cable mechanism 16, in accordance with certain embodiments. Some examples of media transmitter 14 include mobile computers, smartphones, tablet computers, handheld game consoles, portable media players, digital still cameras (DSC), and digital video cameras (DVC or digital camcorder). Generally, these devices are battery powered and need to be periodically charged. Some examples of media receiver 12 include various audio-video systems, TV sets, computer displays, and video projectors.

Media receiver 12 is shown to have input data port 12*a*, while media transmitter 14 is shown to have output data port 14*a*. In certain embodiments, the same port may be an input port in one operation and an output port in another operation. For simplicity, examples presented in this document are focused on media transmitter 14 sending media data and media receiver 12 receiving this data. However, one having ordinary skills in the art would understand that various other types of data flows may be used. Furthermore, as described above, in certain situations, there is no data received from media transmitter 14 and/or transmitted to media receiver 12. In certain embodiments, data transmitted to media receiver 12 may be generated by intelligent cable mechanism 16. Intelligent cable mechanism 16 may be also referred to as an active cable or simply a cable. However, this cable should be distinguished from passive cables and dongles (passive or active).

Intelligent cable mechanism 16 is shown to include first connection end 16*a* connected to output data port 14*a* of media transmitter 14 and second connection end 16*c* connected to input data port 12*a* of media receiver 12. First connection end 16*a* is interconnected with second connection end 16*c* by flexible member 16*b*. Flexible member 16*b* may include a plurality of wires that are insulated with respect to each other and integrated by a common insulating sheath. Flexible member 16*b* allows one first connection end 16*a* to move with respect to second connection end 16*c*. The length of flexible member 16*b* may be at least about 1 meter or, more specifically, at least about 2 meters, and even at least about 4 meters. Standard cable lengths, such as 6 feet, 12 feet, 25 feet, 50 feet, and 100 feet may also define the length of the flexible member 16*b*.

Each one of first connection end 16*a* and second connection end 16*c* includes a connector, which may be a male-type connector or a female type connector. In certain embodiments, first connection end 16*a* and second connection end 16*c* both have male type connectors allowing cable mechanism 16 to interconnect media transmitter 14 and media receiver 12 without any additional cables or devices. This feature of having two male connectors generally distinguishes cables from dongles, as explained above. Various types of video and data connectors may be used for first connection end 16*a* and second connection end 16*c*. Some of these examples are presented below with reference to FIGS. 2A-2F and FIGS. 3A-3D. In specific embodiments, first connection end 16*a* includes a micro- or mini-USB connector configured for connections to various mobile devices such as a mobile phone, a laptop computer, and a tablet computer. In the same or other embodiments, second connection end 16*c* includes an HDMI connector, VGA connector, a Digital Visual Interface (DVI), and a DisplayPort connector. In specific non-limiting embodiments, first connection end 16*a* includes a micro-USB connector, while second connection end 16*c* includes an HDMI connector. In more specific non-limiting embodiments, first connection end 16*a* includes a male micro-USB connector, while second connection end 16*c* includes a male HDMI connector.

First connection end 16*a* and/or second connection end 16*c* may include an integrated circuit, which makes intelligent cable mechanism 16 an "active" cable. For example, an integrated circuit may be provided in first connection end 16*a*, which is connected to output data port 14*a* of media transmitter 14. In another embodiment, an integrated circuit is provided in second connection end 16*c*, which is connected to input data port 12*a* of media receiver 12. In yet another embodiment, one integrated circuit is provided in first connection end 16*a*, which is connected to output data port 14*a* of media transmitter 14, while another integrated circuit is provided in second connection end 16*c* connected to input data port 12*a* of media receiver 12. An example of a connection end having an integrated circuit will now be described in more detail.

Figure 1B:
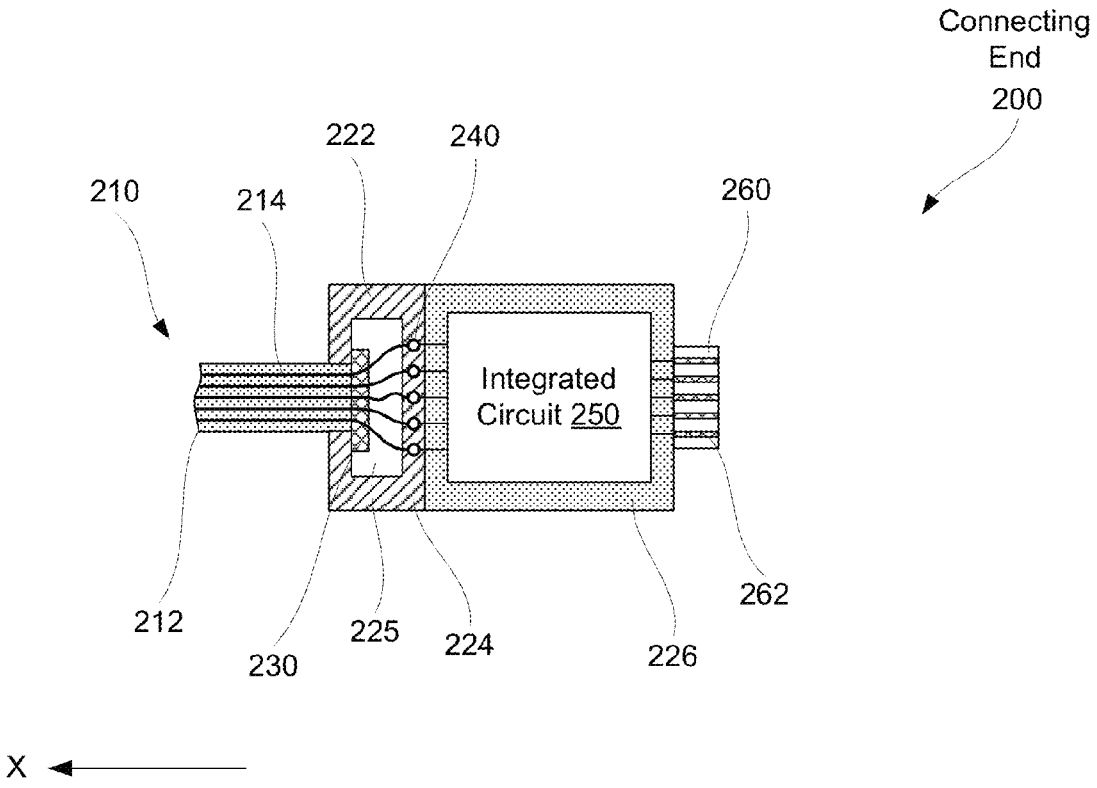
FIG. 1B is a schematic representation of a connection end that contains an integrated circuit, in accordance with certain embodiments.
Figure 2A:
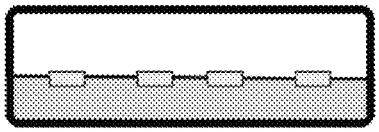
FIGS. 2A-2F are schematic representations of cable connectors for connecting to media transmitters, in accordance with certain embodiments.
Figure 2B:
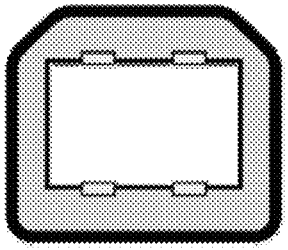
Figure 2C:
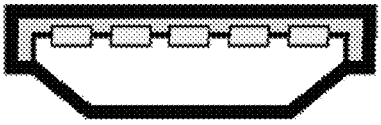
Figure 2D:
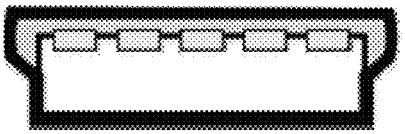
Figure 2E:
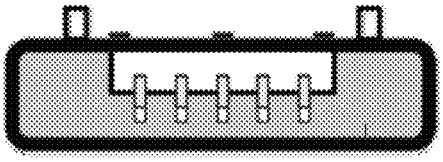
Figure 2F:
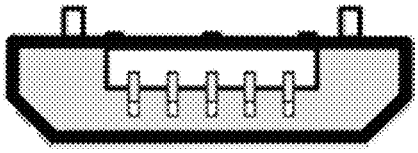

FIG. 1B is a schematic representation of connecting end 200 that contains integrated circuit 250, in accordance with certain embodiments. It should be noted that this example is applicable to either connection end described above with reference to FIG. 1A. Connecting end 200 may be attached to flexible member 210 (e.g., an embodiment of flexible member 16*b* in FIG. 1A) of the cable that extends to the other connecting end. A portion of flexible member 210 may protrude into base member 226 of connecting end 200 to ensure mechanical integration as further explained below. Flexible member 210 is shown to include multiple wires 214 enclosed into insulating sheath 212. The wires 214 may implement a variety of communication lines, such as USB, HDMI, power, ground, data, and other types. These communications lines are further explained below with reference to FIGS. 2A-2F and FIGS. 3A-3D.

Base member 226 of connecting end 200 may be used to support connector 260, which includes multiple conductive points 262. Conductive points 262 may be connected to integrated circuit 250, which is enclosed in base member 226. Various functions of integrated circuit 250 are described elsewhere in this document. Connector 260 may be either a male or female connector. Various types of connectors are explained below with reference to FIGS. 2A-2F and FIGS. 3A-3D. In a specific embodiment, connector 260 is an HDMI connector or even, more specifically, a male HDMI connector.

Base member 226 may be made from one or more materials suitable for electronic connectors, such as polyethylene terephthalate, polybutylene terephthalate, nylon in any of its engineered formulations of Nylon 6 and Nylon 66, polyphenylene sulfide, polyamide, polycarbonate, polyester, polypropylene, polyvinyl chloride, polyphenylene oxide, polymethyl methacrylate, polyphenylene, styrene-acrylonitrile, polystyrene, and various blends based on those materials. Furthermore, thermosetting polymers, such as unsaturated polyester (UP) and epoxy, may be used. Other examples include engineered polymers, which are specifically formulated to meet certain requirements specific for connector applications. For example, certain hybrid block co-polymers may be used. Generally, rigid materials are more suitable for base member 226 in order to provide better mechanical strength and avoid transferring stresses to the internal electrical connections.

Integrated circuit 250 may have a connection pad 240 for making electrical connections to wires 214 of flexible member 210. Multiple connection pads may be provided as well. For example, a separate connection pad may be used for making electrical connections to conductive points 262 of connector 260. Wires 214 may protrude into base member 226 and may be attached to corresponding conductive points of connection pad 240. Wires 214 may be soldered, welded, crimped, or otherwise mechanically and electrically attached to the conductive points of connection pad 240. Integrated circuit 250, in turn, controls connections between the conductive points of connection pad 240 and conductive points 262 of connector 260.

In certain embodiments, base member 226 includes notch members 222 and 224 for supporting flexible member 210 as it protrudes into base member 226. Specifically, notch members 222 and 224 may form a notch through which flexible member 210 protrudes. At the point of protrusion, flexible member 210 may include both insulating sheath 212 and wires 214. Once protruding into a cavity 225 formed by notch members 222 and 224, insulating sheath 212 may be removed, and only wires 214 may individually extend to connection pad 240. It should be noted that individual wires may have individual insulating sheaths that may also extend between notch members 222 and 224, and almost to connection pad 240, in certain embodiments. Though two notch members 222 and 224 are illustrated, additional or fewer notch members may be used.

Notch members 222 and 224 may be attached to a remaining portion of base member 226 or may be monolithic with that portion of base member 226. In either case, notch members 222 and 224 are considered parts of base member 226. In some embodiments, base member 226 is a printed circuit board (PCB) and notch members 222 and 224 are each an extension of the PCB, each of which formed to shape a notch.

In certain embodiments, an enclosure member 230 may be attached to one or more of notch members 222 and 224. For example, enclosure member 230 may be attached at the ends where the notch is formed or elsewhere along notch members 222 and 224. Enclosure member 230 may secure the position of wires 214 as they extend through the notch. Enclosure member 230 may contact individual wires 214 instead of their common insulating sheath 212. In other embodiments, enclosure member 230 secures insulating sheath 212 and, by means of securing insulating sheath 212, secures individual wires 214. This provides additional security to wires 214 and prevents the transferring of stress by wires 214 to conductive points of connection pad 240, in various embodiments. For example, when engaging or disengaging connector 260 from a corresponding device (e.g., a TV set), some stress may be exerted on flexible member 210. If this stress is allowed to transfer to the interface between wires 214 and the conductive points of connection pad 240, then the connections between wires 214 and the conductive points of connection pad 240 may be lost and the entire cable may lose its function. Instead, notch members 222 and 224 and/or enclosure member 230 may help to transfer this stress to base member 226 and away from the interface between wires 214 and the conductive points of connection pad 240. As such, the interface and performance of the cable is preserved.

Utilizing enclosure member 230 in certain embodiments may allow for attaching flexible member 210 to connecting end 200 in a more secure manner than if flexible member 210 were attached solely by the interface between wires 214 and the conductive points of connection pad 240 (e.g., by solder connections provided at this interface).

In certain embodiments, base member 226 is molded over a portion of insulating sheath 212 during fabrication of connecting end 200. Notches, enclosure members, and other features of base member 226 may be also molded in this operation. In the same or other embodiments, notches and/or enclosure members may be compressed over insulating sheath 212 and/or individual wires 214. For example, external mechanical fasteners or compression devices may be used for this purpose. In the same or other embodiments, compression may be provided by compression fitting base member 226 over insulating sheath 212 and/or individual wires 214.

Cavity 225 may be used for individually extending wires 214 to the conductive points of connection pad 240. At this location, wires 214 may be free from their insulating sheath 212. These conductive points may extend into cavity 225. In this example, electrical and mechanical connections between wires and conductive points of connection pad 240 may be made within cavity 225 during assembly of connecting end 200. In certain embodiments, the length of wires 214 extending through cavity 225 may be greater than the width of the cavity extending in the X direction. Therefore, when a stress is applied on flexible member 210 that may cause deformation of base member 226, the flexibility of wires 214 inside cavity 225 may help to prevent the stress from being transferred to the conductive points of connection pad 240. Of course, the rigidity of base member 226 as well as the supporting features of flexible member 210, such as notch members 222 and 224 and enclosure member 230, may help to prevent stress being transferred to the conductive points of connection pad 240. In general, the main concern is with mechanical forces in the X direction that are generated when a user disconnects connector 260 from a port of a receiver or transmitter by pulling flexible member 210.

In certain embodiments, cavity 225 is filled with a filling material that prevents moisture and other undesirable elements from getting into cavity 225. The filling materials may also help to reinforce base member 226 and/or wires 214.

The wires 214 are electronically connected to integrated circuit 250 via one or more connection pads. These connection pads may be pads used to solder, weld, crimp, or otherwise attached wires 214 to integrated circuit 250, which may include a PCB and/or other electronic components. Integrated circuit 250 may perform logic to manage communication between cable ends, as further explained elsewhere in this document.

The present technology may include circuitry and components for performing the functionality described herein, including connectors, data link mechanisms such as wires that communicate data between two or more connectors, and other components. The present technology may be performed by one or more processors that execute instructions stored in memory, with the executed instructions causing one or more processors to perform the functions discussed herein.

Various examples of receiver and transmitter input data ports are presented in FIGS. 2A-2F and FIGS. 3A-3D. Specifically, FIGS. 2A-2F are schematic representations of cable connectors for connecting to media transmitters, in accordance with certain embodiments. These represent different types of USB cable, such as mini-A type USB, mini-B type USB, micro-A type USB, micro-B type USB, and other types. For example, USB 2.0 standard mini and micro connectors have five connector pins, which are sometimes referred to as conductive points. One of these pins is used to provide an electrical power and usually maintained as a voltage of about 5V. Two other pins are used for data transmission (i.e., "Data +" and "Data −"). Yet another pin is used to distinguish between A-type and B-type USB connectors. Finally, the last pin may be used for signal ground.

Figure 3A:
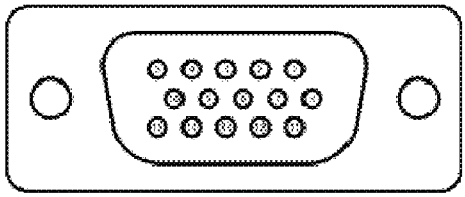
FIGS. 3A-3D are schematic representations of cable connectors for connecting to media receivers, in accordance with certain embodiments.
Figure 3B:
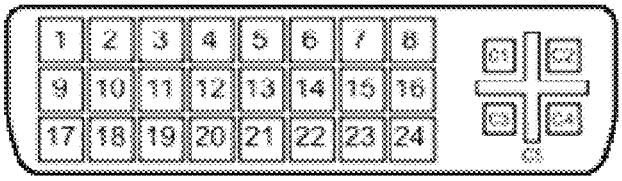
Figure 3C:
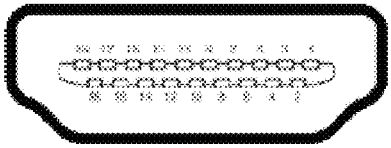
Figure 3D:
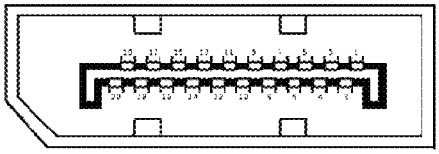

FIGS. 3A-3D are schematic representations of cable connectors for connecting to media receivers, in accordance with certain embodiments. Specifically FIG. 3A depicts a 15-pin VGA connector, FIG. 3B depicts a DVI-I connector, FIG. 3C depicts a 19-pin HDMI connector, and, finally, FIG. 3D depicts a 20-pin DisplayPort external source side connector. Each one of these connectors includes one electrical power pin, which may operate at about 5V, or about 3.3V or some other standard voltage rating.

Figure 4:
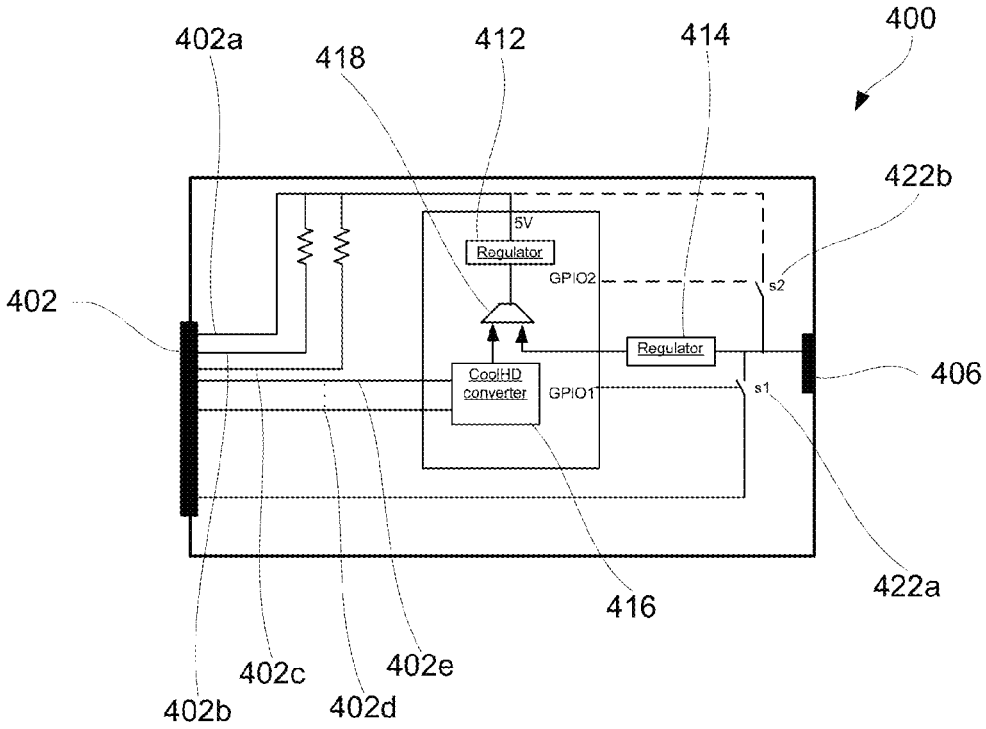
FIG. 4 is a schematic representation of selected electrical components of an integrated circuit of the cable, in accordance with certain embodiments.

FIG. 4 is a schematic representation of selected electrical components of integrated circuit 400 of an active cable, in accordance with certain embodiments. Integrated circuit 400 is shown to include two connection points 402 and 406. These connections points 402, 406 may be connection pads that are used for mechanically attaching and electrically connecting wires of a flexible member.

Connection points 402 and 406 may have various electrical leads extending to them. If connection point 402 corresponds to an HDMI connector, then lead 402*a* may represent a power lead and may be connected to regulator 412. Leads 402*b* and 402*c* may represent Display Data Channel (DDC) leads, while leads 402*d* and 402*e* may represent data lines connected to converter 416. Converter 416 may provide one of the inputs to multiplexer 418, which in turn may control regulator 412. Another input into multiplexer 418 may be provided by another regulator 414, which may be connected to connection point 406. Integrated circuit 400 may also include various switches 422*a* and 422*b*.

While various embodiments have been described above, it should be understood that they have been presented by way of example only and not limitation. The descriptions are not intended to limit the scope of the invention to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the invention as defined by the appended claims and otherwise appreciated by one of ordinary skill in the art. The scope of the invention should, therefore, be determined not with reference to the above description, but instead should be determined with reference to the appended claims along with their full scope of equivalents.

What is claimed is:

1. A cable for transmitting media data, the cable comprising:

a first connector comprising a micro-USB connector including a first plurality of conductive points for establishing a connection with a media transmitter, the first plurality of conductive points comprising at most five conductive points, the media transmitter comprising one or more of a mobile phone, a laptop computer, and a tablet computer;

a second connector comprising a second plurality of conductive points for establishing a connection with a media receiver;

a base member mechanically supporting the second connector;

an integrated circuit enclosed by the base member and connected to the second plurality of conductive points and configured for converting USB data, received via the at most five conductive points of the first plurality of conductive points of the micro-USB connector, into HDMI data, the integrated circuit comprising a connection pad having a third plurality of conductive points; and a flexible member extending between the first connector and the base member, the flexible member comprising a plurality of wires interconnecting the first plurality of conductive points of the first connector and the third plurality of conductive points of the connection pad, a portion of the flexible member protruding into the base member and being rigidly supported by the base member, for reducing stress on connections between the plurality of wires of the flexible member and the third plurality of conductive points of the connection pad.

2. The cable of claim 1, wherein the base member comprises one or more notch members securing and rigidly supporting the flexible member as the flexible member protrudes into the base member.

3. The cable of claim 2, wherein the one or more notch members form a cavity within the base member; and wherein wires of the plurality of wires individually extend to the third plurality of conductive points within the cavity.

4. The cable of claim 3, wherein the flexible member comprises an insulating sheath insulating and mechanically integrating the plurality of wires; and wherein the plurality of wires are substantially free from the insulating sheath while extending through the cavity.

5. The cable of claim 3, wherein the base member comprises an enclosure member provided in the cavity formed by the one or more notch members; and wherein the enclosure member supports individual wires of the plurality of wires.

6. The cable of claim 5, wherein the enclosure member is for preventing the plurality of wires from being pulled out of the cavity.

7. The cable of claim 3, wherein the cavity is filled with a filling material.

8. The cable of claim 2, wherein the one or more notch members are molded over a portion of the flexible member.

9. The cable of claim 2, wherein the one or more notch members are compressed around a portion of the flexible member.

10. The cable of claim 1, wherein the media receiver comprises one or more devices selected from the group consisting of: a TV set, a video display, and a video projector.

11. The cable of claim 1, wherein the second connector comprises an HDMI connector.

12. The cable of claim 1, wherein the base member is a part of a docking station.

13. The cable of claim 1, wherein the integrated circuit is configured to recycle power back to the media transmitter via the first connector.

14. The cable of claim 1, wherein the integrated circuit is configured to generate a signal delivered to the second connector.

15. A cable for transmitting media data, the cable comprising:

a male micro-USB connector comprising a first plurality of conductive points, the first plurality of conductive points comprising at most five conductive points;

a male HDMI connector comprising a second plurality of conductive points;

a base member mechanically supporting the male HDMI connector;

an integrated circuit enclosed by the base member and connected to the second plurality of conductive points and configured for converting USB data, received via the at most five conductive points of the first plurality of conductive points of the male micro-USB connector, into HDMI data, the integrated circuit comprising a connection pad having a third plurality of conductive points; and a flexible member extending between the male micro-USB connector and the base member, the flexible member comprising a plurality of wires interconnecting the first plurality of conductive points of the male micro-USB connector and the third plurality of conductive points of the connection pad, wherein a portion of the flexible member protrudes into the base member and is rigidly supported by the base member, thereby reducing stress on connections between the plurality of wires of the flexible member and the third plurality of conductive points of the connection pad.

16. The cable of claim 15, the base member further comprising one or more notch members, wherein the portion of the flexible member is rigidly supported by the one or more notch members.

* * * * *